US009404452B2

(12) United States Patent
Petersson

(10) Patent No.: US 9,404,452 B2
(45) Date of Patent: Aug. 2, 2016

(54) COMBUSTION ENGINE POWERED WORKING MACHINE

(75) Inventor: Hans Petersson, Landvetter (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 13/513,538

(22) PCT Filed: Dec. 2, 2009

(86) PCT No.: PCT/SE2009/051367

§ 371 (c)(1),
(2), (4) Date: Aug. 20, 2012

(87) PCT Pub. No.: WO2011/068446

PCT Pub. Date: Jun. 9, 2011

(65) Prior Publication Data

US 2012/0311873 A1 Dec. 13, 2012

(51) Int. Cl.
*F02M 35/06* (2006.01)
*F02M 35/024* (2006.01)
(Continued)

(52) U.S. Cl.
CPC ..... *F02M 35/06* (2013.01); *F02M 35/024* (2013.01); *F02M 35/0226* (2013.01); *F02M 35/1017* (2013.01); *F02B 63/02* (2013.01)

(58) Field of Classification Search
CPC ..... F02B 63/02; F01P 11/12; F01P 5/06; F02M 35/06; F02M 35/1017; F02M 35/08; F02M 35/10262
USPC ..... 123/41.1, 41.49, 41.56, 41.63, 41.65, 123/195 R; 30/277.4, 6, 216, 381, 371
See application file for complete search history.

(56) References Cited

U.S. PATENT DOCUMENTS 5,231,956 A * 8/1993 Lux ..... B27B 17/00 123/198 E
5,269,265 A * 12/1993 Pretzsch ..... F01P 5/06 123/198 E (Continued)

FOREIGN PATENT DOCUMENTS

WO 2006006894 A1 1/2006
WO 2011068446 6/2011

OTHER PUBLICATIONS

English Abstract of Japanese Publication No. JP 2007113443, published May 10, 2007, downloaded May 30, 2012, 2 pages.

(Continued)

*Primary Examiner* — Lindsay Low
*Assistant Examiner* — Long T Tran
(74) *Attorney, Agent, or Firm* — Nelson Mullins Riley & Scarborough LLP

(57) ABSTRACT

A portable, hand-held, combustion engine powered working machine, e.g. a power cutter, chain saw or trimmer, comprising: a tool unit including a working tool; a machine unit (104) including an internal combustion engine (204) with a crankshaft (304); an assembly for supplying cleaned air and fuel to the engine, having an upstream air inlet; a fan housing (404) located in an outer end of said tool unit and having an air inlet for ambient air; a fan wheel (302) arranged in the fan housing (404); the fan wheel (302) driven by the crankshaft (304) to supply cooling air, sucked in through the air inlet to cool the engine (204); a combustion air duct (406) having a combustion air intake opening (408) located radially outside of the fan wheel (302) leads the combustion air to the assembly for supplying cleaned air and fuel to the engine via a possible air filter (402). Special shielding elements (410, 412, 414) are used to steer away air and especially particles in the air from said combustion air intake opening (408) to provide a strong cleaning effect of the combustion air in said combustion air duct (406).

22 Claims, 6 Drawing Sheets

(51) Int. Cl.

| | |
|---|---|
| ***F02M 35/10*** | (2006.01) |
| ***F02M 35/022*** | (2006.01) |
| *F02B 63/02* | (2006.01) |

(56) References Cited

U.S. PATENT DOCUMENTS

| | | | | | |
|---|---|---|---|---|---|
| 5,363,815 | A * | 11/1994 | Pretzsch et al. | 123/41.7 | |
| 5,367,988 | A * | 11/1994 | Collins | B27B 17/00 | 123/198 E |
| 5,377,632 | A * | 1/1995 | Aronsson . | B24B 27/08 | 123/198 E |
| 5,526,777 | A * | 6/1996 | Taomo | B27B 17/00 | 123/198 E |
| 5,542,380 | A * | 8/1996 | Chatten | B27B 17/00 | 123/198 E |
| 5,720,243 | A | 2/1998 | Stegemyr et al. | | |
| 6,314,922 | B1 * | 11/2001 | Zimmermann | B25F 5/008 | 123/41.56 |
| 6,374,501 | B1 * | 4/2002 | Claesson | B23D 47/123 | 125/13.01 |
| 6,378,467 | B1 * | 4/2002 | Kobayashi | F01P 1/02 | 123/41.56 |
| 6,494,180 | B1 * | 12/2002 | Schlossarczyk | 123/392 | |
| 7,478,613 | B2 * | 1/2009 | Gunnarsson et al. | 123/41.63 | |
| 8,328,501 | B2 * | 12/2012 | Brazell et al. | 415/121.2 | |
| 2009/0293821 | A1 * | 12/2009 | Nakamizo | F01P 5/06 | 123/41.65 |
| 2012/0285410 | A1 * | 11/2012 | Stark | F02M 35/024 | 123/184.21 |

OTHER PUBLICATIONS

International Search Report for International Application No. PCT/SE2009/051367, dated May 10, 2010, 4 pages.

Written Opinion for International Application No. PCT/SE2009/051367, dated May 10, 2010, 5 pages.

* cited by examiner

COMBUSTION ENGINE POWERED WORKING MACHINE

CROSS-REFERENCE TO RELATED APPLICATIONS

This application is a national stage entry of PCT/SE2009/051367, which was filed on Dec. 2, 2009, said application is expressly incorporated herein in its entirety.

TECHNICAL FIELD

The present invention relates to a portable hand-held working machine such as, but not limited to, a power cutter, chain saw or trimmer that are powered by internal combustion engines. In particular, the present invention relates to an air cleaning system for internal combustion engines which are used in such working machines and include: a fan housing located in an outer end of a machine unit and having an air inlet for ambient air;

a fan wheel arranged in the fan housing;

the fan wheel driven directly or indirectly by the crankshaft to supply cooling air, sucked in through the air inlet to cool the engine;

a combustion air duct having a combustion air intake opening located radially outside of the fan wheel leads the combustion air to an assembly for supplying cleaned air and fuel to the engine via a possible air filter.

BACKGROUND OF THE INVENTION

Portable hand-held working machines powered by internal combustion engines are known since long. These machines are often used for cutting concrete and similar materials. Such a cutting creates a lot of abrasive particulate matter. Also, before introducing the air for combustion in the engine, if the air is not cleaned then the engine may wear out, due to an abrasive action of the particulate matter. Typically, efficient air cleaning is vital and is attained mainly through a filter assembly having a sufficient filter volume, which may increase a service life of the machine.

To achieve an enhanced air cleaning, a centrifugal air cleaning step is typically included before air enters the filter assembly. For example U.S. Pat. No. 7,520,276 and WO 2006/006894 both assigned to Husqvarna AB describe a filter assembly for a portable hand-held working machine. The disclosure of both are herewith incorporated in the present application by reference. The filter assembly utilizes a pre-filter followed by a main filter for further cleaning of centrifugally cleaned air from a fan assembly. The pre-filter is a washable filter while the main filter is a disposable paper filter. This is a fairly efficient, however a rather complicated air cleaning system with two filters and a need for washing the washable filter at certain time intervals. This kind of service is costly. Also the air filter needs to be changed at time intervals.

In light of the foregoing, there is a need for an efficient air cleaning system, for an internal combustion engine of a portable working machine which may have a simple design and a lower number of components and allow longer service intervals.

BRIEF DISCLOSURE OF THE INVENTION

In view of the above, it is an objective to solve or at least reduce the problems discussed above. In particular, the objective is to provide an efficient air cleaning system, for an internal combustion engine of a portable hand-held working machine, which has a simple design and a minimum number of components.

The objective is achieved with a novel portable, hand-held, combustion engine powered working machine according to claim 1, in which the machine comprises a tool unit and a machine unit. The tool unit includes a working tool while the machine unit includes an internal combustion engine with a crankshaft, an assembly for supplying cleaned air and fuel to the engine with an upstream air inlet, and a fan housing located in an outer end of the machine with an air inlet for ambient air. Further, a fan wheel, which is arranged in the fan housing, is driven directly or indirectly by the crankshaft to supply cooling air, which is sucked through the ambient air inlet, to the engine. A combustion air duct, having a combustion air intake opening leads the combustion air to the assembly, which supplies cleaned air and fuel to the engine, via at least one filter. The combustion air intake opening is located radially outside of the fan wheel and includes at least one shielding element to steer away air and especially particles in the air form the combustion air intake opening to provide a strong cleaning effect of the combustion air in the combustion air duct. Advantageously, the presence of the at least one shielding element may result in the usage of a single filter; preferably of a throw away type, instead of two or more filters, to achieve at least the same air cleaning efficiency, thereby simplifying a design and reducing the number of components of the air cleaning system. Further as the cleaning before the filter system has been improved there will be a slower build up of dust in the filter/s. Hereby service intervals can be prolonged, which is very important. Also a higher degree of air cleaning can be attained both if using one or two filters.

According to claim 2, a first shielding element is arranged in the form of a deflector which is attached to the combustion air intake opening and extends in an essentially longitudinal direction. The longitudinal direction is parallel to the direction of the crankshaft. The deflector is utilized to deflect particles, present in high speed air flowing out of fan wheel wings, away from the combustion air intake opening.

According to claim 3, the deflector is attached to an inner side of the combustion air intake opening which is the side closest to the fan wheel. Such configuration of the deflector further increases its efficiency in deflecting particles from the combustion air intake opening.

According to claims 4 and 5, the deflector has width w, in a direction perpendicular to its longitudinal direction, which varies in various embodiments of the present invention. The width w may be bigger than 3 mm and preferably bigger than 4 mm. Alternatively, the width w may be bigger than 5 mm and preferably bigger than 6 mm.

According to claim 6, at least one second shielding element is attached on one or both lateral sides of the combustion air intake opening to make it harder for particles to enter the combustion air intake opening, in a partly longitudinal direction which is parallel to the crankshaft.

According to claim 7, two second shielding elements is attached on each lateral side of the combustion air intake opening. Further, a longitudinal distance LD between the two facing surfaces of the second shielding elements is smaller than and overlaps a longitudinal fan wheel distance LFD, as measured for maximum fan wing longitudinal width. The second shielding elements prevent slower speed air from sides to reach the combustion intake air opening and ensure that only fast moving air from the fan wings reach the deflector and the combustion air intake opening. Since the deflector requires high speed air to be effective in deflecting particles away from the combustion air intake opening, the second shielding elements help in an efficient functioning of the deflector.

According to claim 8, a third shielding element is arranged at a radially outer side of the combustion air intake opening. Further, the third shielding element includes a leading edge, of the radially outer side, which is bent radially inwards.

According to claim 9, a tangential line from the fan wheel over the outside of the deflector clears, i.e. does not meet the leading edge of the outer side of the combustion air intake opening. Alternatively, according to claim 10, a tangential line from the fan wheel along the outer side of the deflector does not meet the leading edge. Further, the deflector has an essentially flat or concave outer side. Such a shape and configuration of the leading edge enables the deflector to be more effective in deflective particles away from the combustion air intake opening.

According to claim 11, the working machine is a power cutter and the combustion air duct leads combustion air to the air inlet of the assembly via only a single air filter.

According to claim 12, a main filter is a fan-folded paper filter and is maintained by a gasket ring of a soft material encircling the lower circumferential edge of the fan-folded filter. Further, the gasket ring is accommodated in a gasket groove encircling the upper part of a bracket.

According to claim 13, the shielding elements steer away air and particles in the air from said air intake opening, so that an air pressure below ambient air pressure is created in the combustion air duct over the complete speed range of the engine. This air pressure, which is below ambient air pressure, serves to suck additional air into the combustion air duct. According to claim 14, an air pressure, which is below ambient air pressure, is created in the combustion air duct over the working speed range of the engine. According to claim 15, an air pressure, which is below ambient air pressure, is created in the combustion air duct over the speed range of the engine in combination with full throttle.

According to claim 16-18 an improved cooling capacity can be reached as described below referring to FIG. 6.

Other aspects, achievements and characteristic features of the invention are apparent from the appending claims and from the following description of preferred embodiments of the invention.

BRIEF DESCRIPTION OF THE DRAWINGS

In the following description of preferred embodiments, reference will be made to the accompanying drawings, in which.

DESCRIPTION OF A PREFERRED EMBODIMENT

Figure 1:
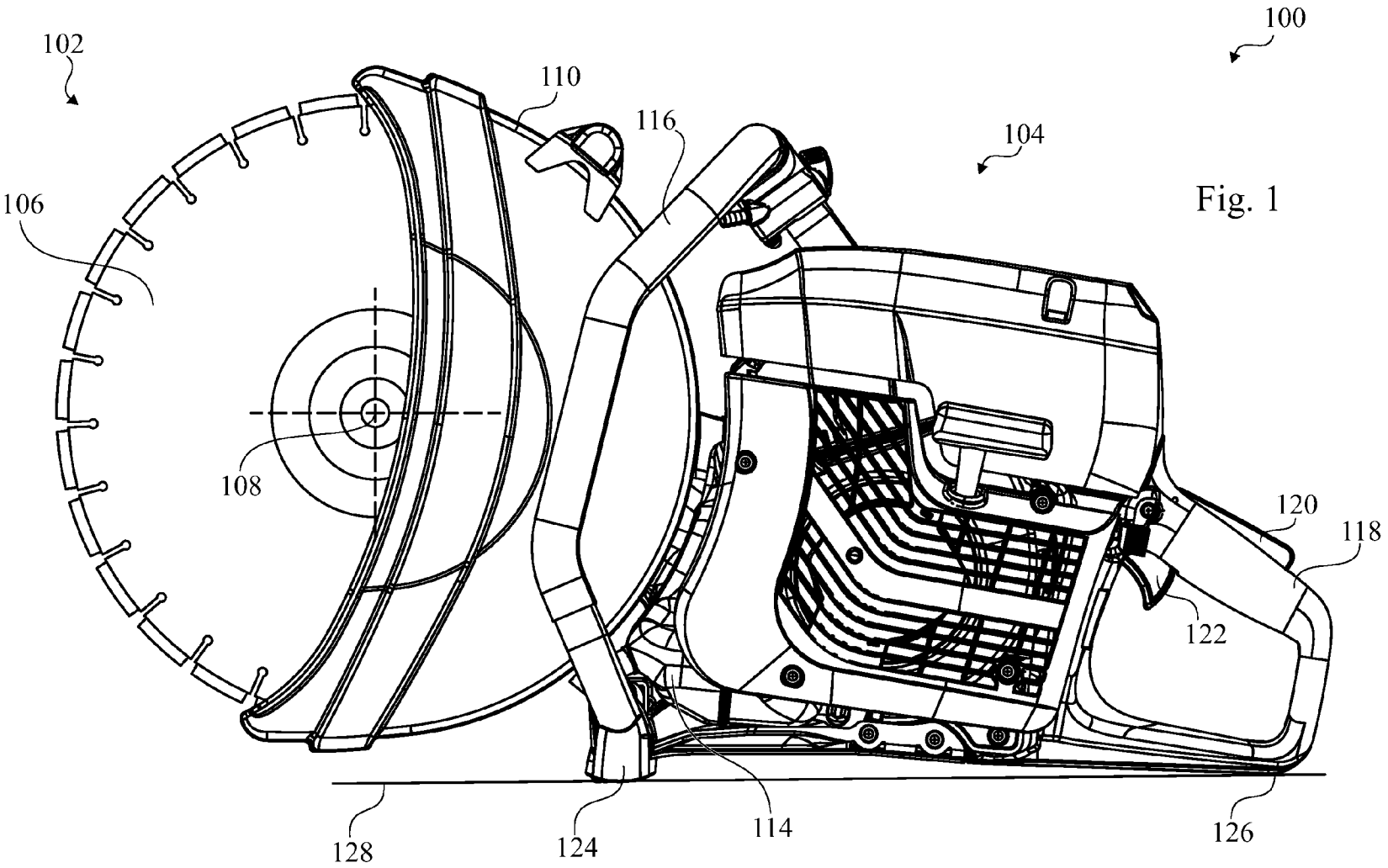
FIG. 1 shows a side elevation view of a portable hand-held working machine, according to an embodiment of the present invention.

The present invention will be described more fully hereinafter with reference to the accompanying drawings, in which example embodiments of the invention incorporating one or more aspects of the present invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention can be utilized in other embodiments and even other types of devices. In the drawings, like numbers refer to like elements.

Figure 2:
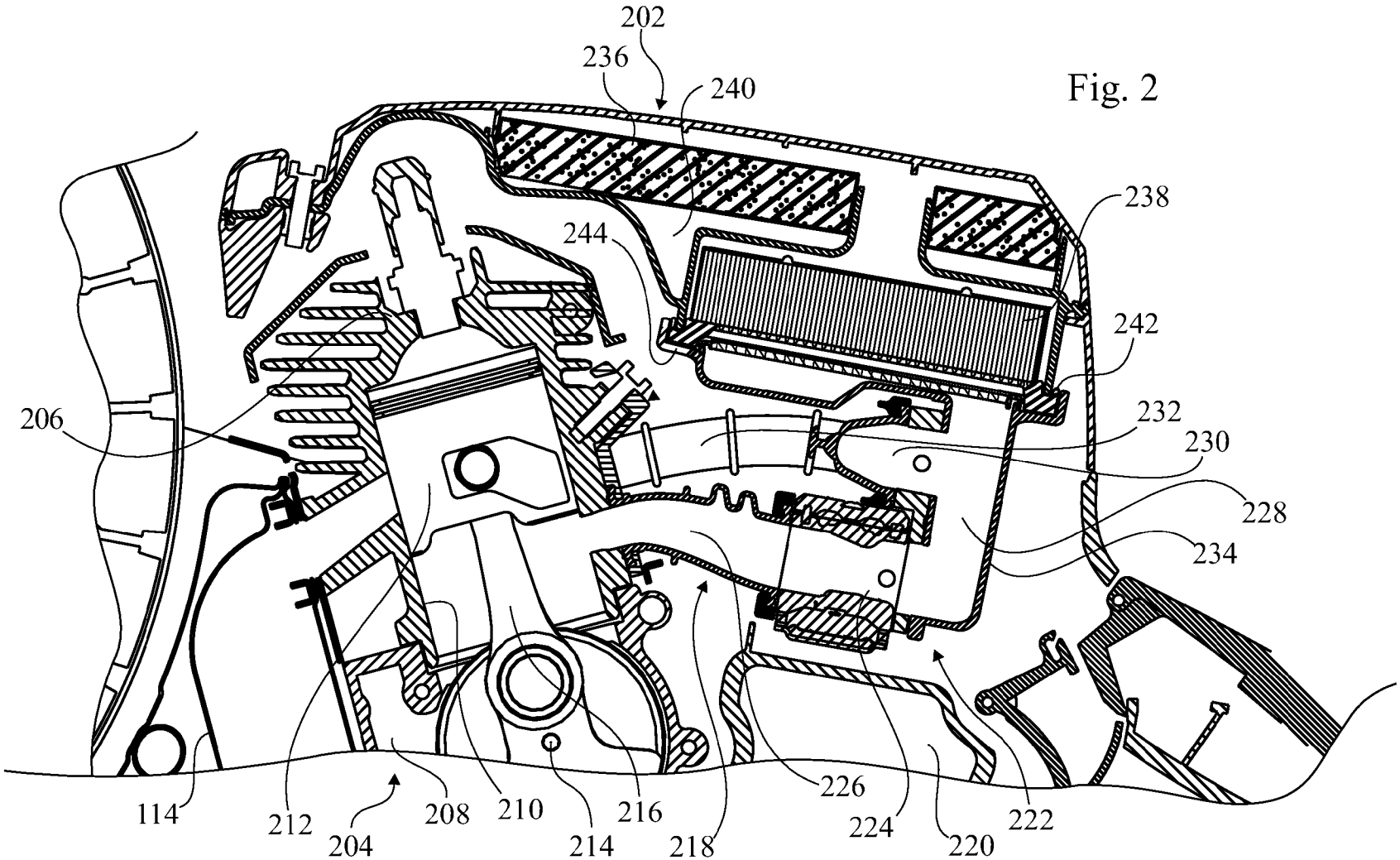
FIG. 2 shows a longitudinal cross-section of a tool unit, according to an embodiment of the present invention.

FIGS. 1 and 2 show an example portable hand-held working machine 100 incorporating some aspects of the present invention. Although the described example in FIGS. 1 and 2 is a power cutter, it should be understood that the present invention may be incorporated in any suitable type of power tool or portable hand-held working machine and is not limited to use merely in a power cutter and, may be incorporated in different types of embodiments. Examples of portable hand-held working machines may include, but not limited to, chain saws, trimmers etc.

The portable hand-held working machine 100 may include a tool unit 102 and a machine unit 104. The tool unit 100 may be provided with a working tool 106. In an embodiment of the present invention, the working tool 106 may be a cutter disc with attached segments with diamonds to aid in a cutting of hard or abrasive materials. The working tool 106 may be rotated about an axis of rotation 108 which may be perpendicular to the plane of the paper in the normal upraised position of the machine, as shown in FIG. 1. Further, the working tool 106 may also include a disc guard 110 in a conventional manner.

As shown in FIG. 2, the machine unit 104 may include a filter assembly 202 and an internal combustion engine 204. In an embodiment of the present invention, the internal combustion engine 204 may be a two-stroke internal combustion engine. In yet another embodiment of the present invention, the internal combustion engine 204 may be a four-stroke internal combustion engine. As shown in the exemplary embodiment of FIG. 2, the internal combustion engine 204 may include a cylinder bore 206 and a crankcase 208. In an embodiment of the present invention, the internal combustion engine 204 may include two or more cylinders (not shown in FIG. 2). The cylinder 206 may include a cylinder bore 210 in which a piston 212 may reciprocate. Further, the piston 212 may be connected to a crank arm 214 via a connecting rod 216. The crank arm 214 may be a part of a crankshaft (not shown in FIG. 2). Further, the machine unit 104 may include an assembly 218, a fuel tank 220, a muffler 114, handles 116 and 118, and controls 120 and 122. The assembly 218 may be utilized to supply cleaned air and fuel to the engine 204. Additionally, a front support 124 and a rear support 126 may be provided on an underside of the machine unit 104 to allow an upright positioning of the machine 100 on a flat surface. An endless driving belt (not shown in FIGS. 1 and 2) may transmit power from the machine unit 104 to the working tool 106 in a conventional manner.

In an embodiment of the present invention, the cylinder 206 and the crankcase 208 may be tilted in a forward direction. In an exemplary embodiment of the present invention, a tilt angle α (not shown in FIGS. 1 and 2), between a centre line of the cylinder 206 and a perpendicular to a base plane 128, may be substantially equal to 15 degrees. As shown in the exemplary embodiment of FIG. 1, the base plane 128 may be a horizontal plane, perpendicular to the plane of the paper, on which the front support 124 and the rear support 126 may rest. It should be understood that the reference to the base plane 128, in order to describe the degree of tilt of the cylinder 206 and the crankcase 208, presupposes that a height of the supports 124 and 126 are moderate.

Further, a space 222 may be provided above the fuel tank 220. The space 222 may be of a substantial volume and may extend in a longitudinal direction due to the inclination of the engine 204. The space 222 may be utilized to accommodate the filter assembly 202 and the assembly 218. As shown in FIG. 2, the assembly 218 may be placed in between the fuel tank 220 and the filter assembly 202. Further, the assembly 218 may include a carburettor 224 and an intake pipe 226. The intake pipe 226 may extend between the carburettor 224 and an induction port of the cylinder 206. An air inlet 228 may serve to supply cleaned air to the carburettor 224 from the filter assembly 202. In a preferred embodiment of the present invention, the engine 204 is a crankcase scavenged two-stroke internal combustion engine having an additional air supply arranged to its transfer ducts (not shown in FIG. 2). Therefore the assembly 218 includes an additional air inlet 230 for the additional air supply to the transfer ducts, and preferably two parallel connecting ducts 232 are provided to link the additional air inlet 230 to the connecting ports in the cylinder wall. However, in other embodiments of the present invention, the engine 204 may be a conventional two-stroke internal combustion engine, or a four stroke engine. Neither of them has an additional air supply. As shown in FIG. 2, the additional air inlet 230 and the connecting ducts 232 may be advantageously accommodated in the space 222. In an embodiment of the present invention, the carburettor 224, the air inlet 228, the intake pipe 226 and the connecting ducts 232 may be assembled and mounted on an air filter supporting bracket 234. The bracket 234 may be mounted in a rear part of the space 222, near a rear wall of the machine unit 104. In an embodiment of the present invention, the bracket 234 may be integrated with the filter assembly 202.

In an embodiment of the present invention, the filter assembly 202 may include a pre-filter 236 and a main filter 238. Additionally, a swirling chamber 240 may be provided partly below the pre-filter 236. In an embodiment of the present invention, the pre-filter 236 may be made of foamed plastics soaked with oil and the main filter 238 may be a paper filter. The filter paper, of the main filter 238, may be fan-folded and may be secured through molding to a comparatively thick and broad gasket ring 242 which may be made of soft rubber or a soft thermoplastic material. The gasket ring 242 may encircle the main filter 238 in a bottom part of the main filter 238. In an embodiment of the present invention, the gasket ring 242 may be accommodated in a gasket groove 244 which may encircle an upper part of the bracket 234. In another embodiment of the present invention, a protective filter (not shown in FIG. 2) may be provided below the main filter 238. The protective filter may serve to prevent an accidental entry of objects into an air inlet 228. The protective filter may, for example but not limiting to, include a metal net. Further, the filter assembly 202 may at least partly form a part of an integrated air cleaning system (not shown in FIG. 2) for cleaning the air that is supplied to the engine 204. In an embodiment of the present invention, the air cleaning system may clean air in multiple steps which may include, in a direction of the air flow, a first dynamic cleaning step, a second dynamic cleaning step, a first filtering step in the pre-filter 236, and a second filtering step in the main filter 238. In another embodiment of the present invention, a single filtering step may be performed.

Figure 3:
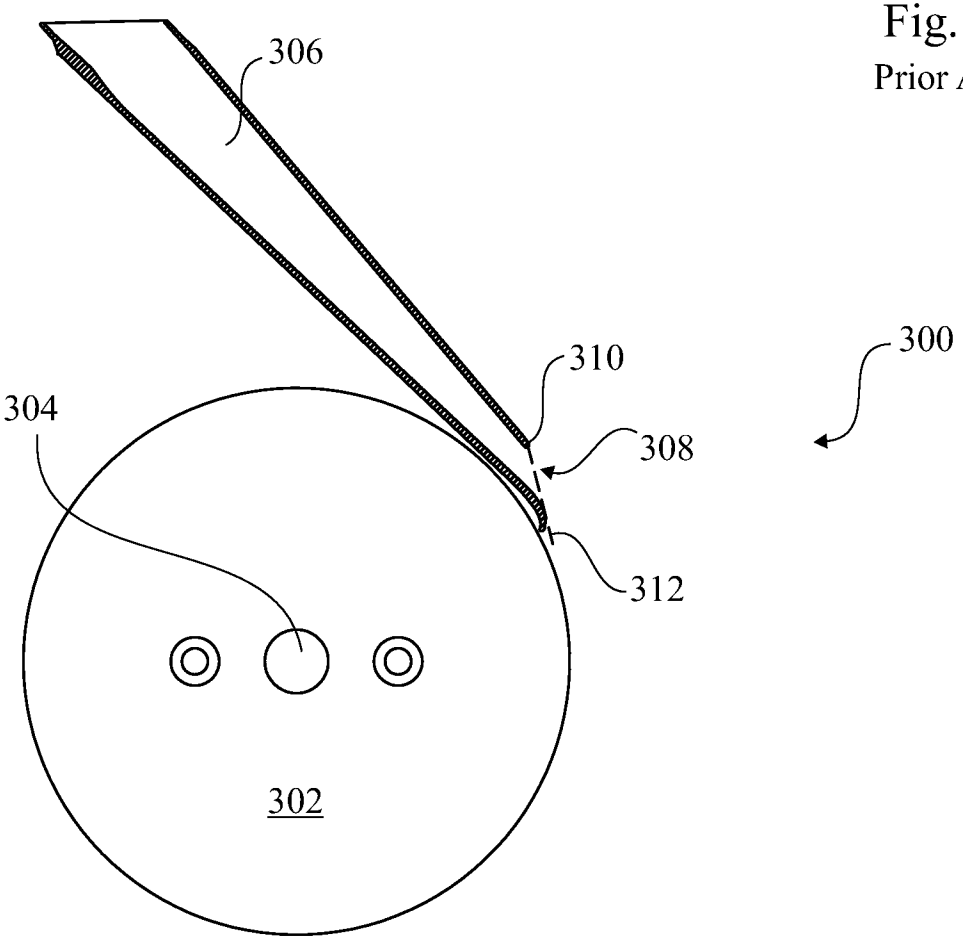
Fig. 3 Prior Art
FIG. 3 shows a sectional view of a prior art first dynamic air cleaning system.

FIG. 3 shows a sectional view of a prior art first dynamic air cleaning system 300 for performing the first dynamic cleaning step. The first dynamic air cleaning system 300 may at least form part of an air cleaning system (not shown in FIG. 3). The first dynamic cleaning system 300 includes a fan wheel 302 which may be mounted on a crankshaft 304. The fan wheel 302 may provide combustion air as well as cooling air to the engine 204. In air laden with particles the particles, which are heavier than air, will be urged by a comparatively higher centrifugal force to a radially outward region while substantially cleaner air will experience a lower centrifugal force and be retained in a radially inward region. Thus, air may be centrifugally purified due to a radial flow induced by the fan wheel 302 and a flow of substantially cleaner air may be separated from air with much more particles such as dust, powdered concrete, stone powder etc. A combustion air duct 306 may be provided to accept the substantially cleaner air through an air intake opening 308. The air intake opening 308 may include a radially outer side 310. Typically, the radially outer side 310 may be positioned such that a tangential line 312 from the fan wheel 302 may intersect with the radially outer side 310.

After the first dynamic cleaning step, air may be guided to the swirling chamber 240 via the combustion air duct 306. A flow of air in an upward direction through the combustion air duct and a subsequent backward flow on encountering the swirling chamber 240 may generate strong turbulence in the swirling chamber 240. The strong turbulence may cause a substantial fraction of residual particulate matter, which may be present in air after centrifugal cleaning, to be deposited on various surfaces of the swirling chamber 240, such as walls, floor and ceiling. This may constitute the second dynamic cleaning step. After the second dynamic cleaning step, air may pass through the pre-filter 206. In the first filtering step, a majority of remaining particulate matter may be collected in the oil soaked filter. In the main filter 238, a majority of any remaining particulate matter, after the first filtering step, may be collected in the second filtering step before the air enters the air inlet 228 via the protective filter.

Figure 4:
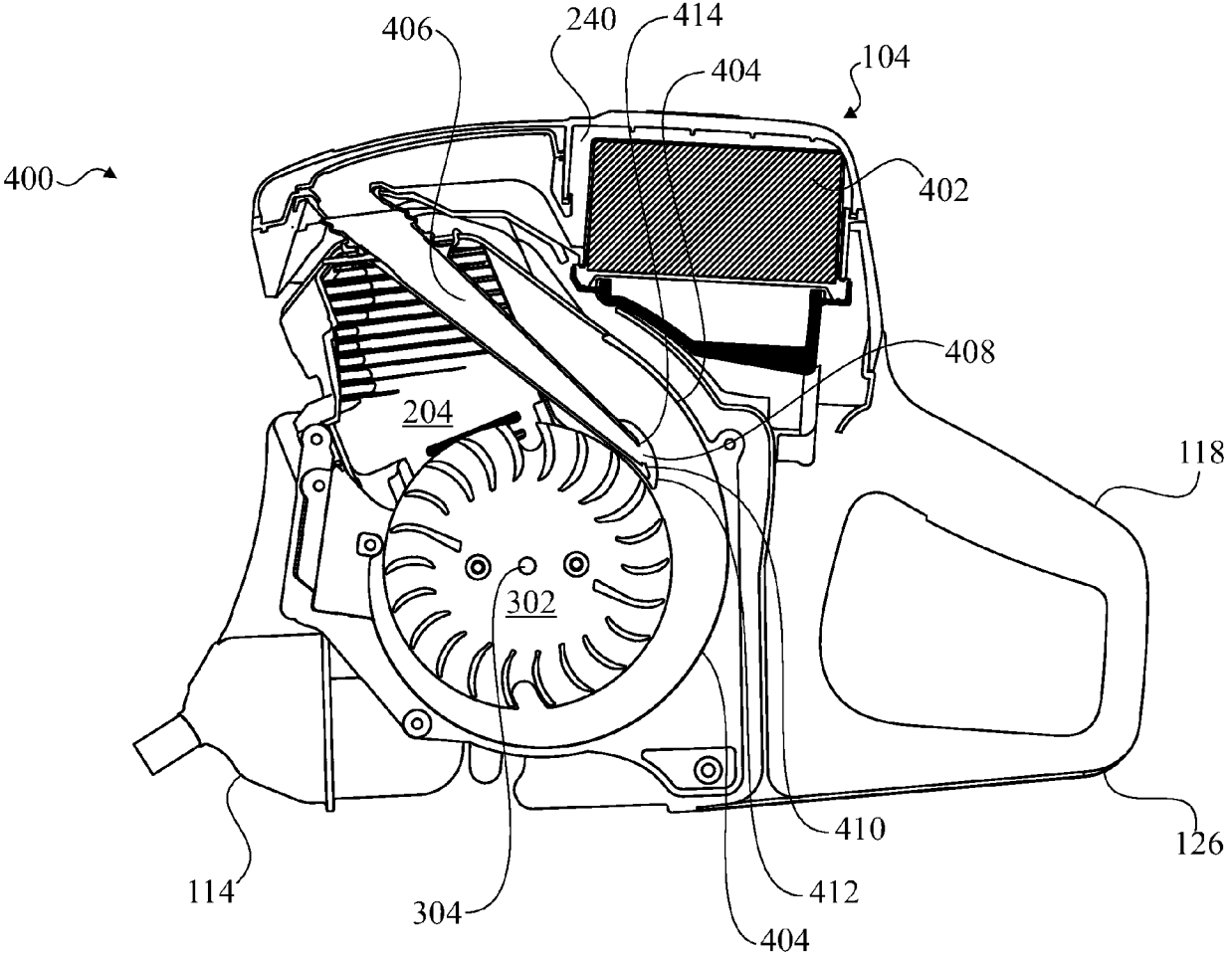
FIG. 4 shows a sectional view of an air cleaning system, according to an embodiment of the present invention.

FIG. 4 shows a sectional view of an air cleaning system 400 according to a preferred embodiment of the present invention. In the exemplary embodiment of FIG. 4, a single filter 402 is shown. However, in another embodiment of the present invention, a pre-filter and a main filter (not shown in FIG. 4), such as described in the exemplary embodiment of FIG. 2, may also be present. The air cleaning system 400 may also include the fan wheel 302. In an embodiment of the present invention, the fan wheel 302 may be mounted on the crankshaft 304 and hence, driven directly by the crankshaft 304 at an engine speed. In another embodiment of the present invention, the fan wheel 302 may be indirectly driven by the crankshaft 304 via suitable power transmission means (not shown in FIG. 4), for example but not limiting to, gear assembly, belt-pulley assembly, linkage assembly, or the like. In such a case, the fan wheel 302 may or may not rotate at the engine speed. The fan wheel 302 may include centrifugal wings. Further, the fan wheel 302 is disposed in a fan housing 404. The fan housing 404 may be located on an outer end of the machine unit 104 and may include an air inlet for ambient air (not shown in FIG. 4). Air is typically sucked in through the air inlet for ambient air. In an embodiment of the present invention, the fan housing 404 may be a spiral housing. In a first dynamic cleaning step, the fan wheel 302 may induce a centrifugal purification of air. A combustion air duct 406 may be provided to carry air from the fan wheel 302 to the swirling chamber 240. The second dynamic cleaning step may be completed in the swirling chamber by promoting turbulence. Subsequently, a single filtering step may be performed in the single filter 402. Air may then flow to the air inlet 228 and hence, to the assembly 218.

In an embodiment of the present invention, the combustion air duct 406 includes a combustion air intake opening 408 which is located radially outside the fan wheel 302 to accept a flow of air. At least one shielding element is provided on the combustion air intake opening 408. The at least one shielding element may be utilized to provide an additional cleaning effect on air in the combustion air duct 406, thus augmenting the multiple cleaning steps of air. In an embodiment of the present invention, at least one of the shielding elements may be configured to steer away air and particulate matter from the combustion air intake opening 408 such that an air pressure, which may be below an ambient air pressure, may be created in the combustion air duct 406 over a complete speed range of the engine 204. In another embodiment of the present invention, an air pressure, which may be below an ambient air pressure, may be created in the combustion air duct 406 over a working speed range of the engine 204. In yet another embodiment of the present invention, an air pressure, which may be below an ambient air pressure, may be created in the combustion air duct 406 over a speed range of the engine 204 in combination with full throttle.

In an embodiment of the present invention, the at least one shielding element may include a first shielding element 410, a second shielding element 412, and a third shielding element 414. In an embodiment of the present invention, the first shielding element 410 may be configured as a deflector 410 which may be attached the combustion air intake opening 408. The deflector 410 may extend in a substantially longitudinal direction which may be perpendicular to the plane of the paper and parallel to the crankshaft 304. In an embodiment of the present invention, the deflector 410 may be attached to an inner side of the combustion air intake opening 408 which is the side which is closest to the fan wheel 302. In an embodiment of the present invention, the second shielding element 412 may be attached to at least one lateral side of the combustion air intake opening 408. In another embodiment of the present invention, there may be two second shielding elements 412 that may be attached to each of the lateral sides of the combustion air intake opening 408. The second shielding element 412 may be configured to at least partly impede an entry of particulate matter inside the combustion air intake opening 408 in the longitudinal direction. In an embodiment of the present invention, the third shielding element 414 may be disposed at a radially outer side of the combustion air intake opening 408. The third shielding element 414 may include a leading edge 414 of the radially outer side of the combustion air intake opening 408.

Figure 6:
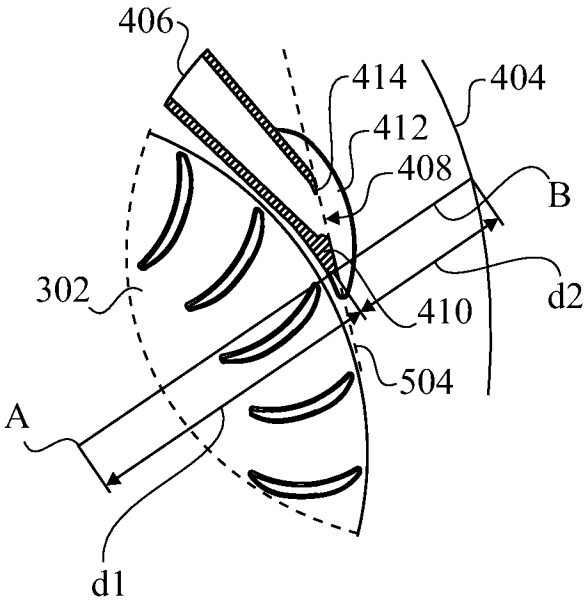
FIG. 6 shows a detailed sectional view of a combustion air intake opening, according to an embodiment of the present invention.
Figure 5:
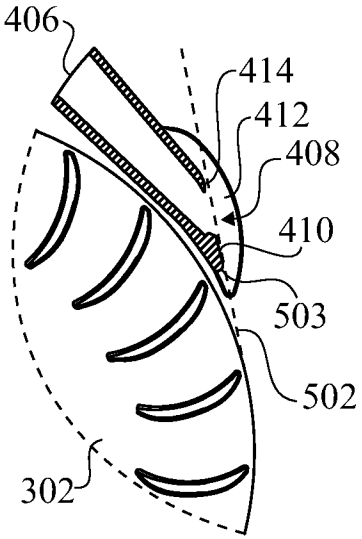
FIG. 5 shows a detailed sectional view of a combustion air intake opening, according to an embodiment of the present invention.

FIGS. 5 and 6 show detailed sectional views of the combustion air intake opening 408 according to various embodiments of the present invention. As shown in the example embodiments of FIGS. 5 and 6, the deflector 410 may have an essentially concave outer side and the leading edge 414 may be bent radially inward. However, in another embodiment of the present invention, the deflector 410 may have an essentially flat outer side. The deflector 410 may have a width 'w' in a direction perpendicular to a longitudinal direction of the deflector 410. In an embodiment of the present invention the width 'w' may be more than 3 mm and preferably may be more than 4 mm. In another embodiment of the present invention, the width 'w' may be more than 5 mm and preferably may be more than 6 mm. As shown in the example embodiment of FIG. 5, a tangential line 502, which may be tangential to the fan wheel 302 and oriented along the outer side of the deflector 410, may not intersect with the leading edge 414. Further, as shown in the example embodiment of FIG. 6, a deflector line 504, which may be oriented along the outer side of the deflector 410, may not intersect with the leading edge 414. As shown in the example embodiment of FIG. 6, the fan wheel 302 rotates about an axis A and the combustion air intake opening 408 is provided with a first edge 503 radially adjacent to the periphery of the fan wheel 302 and the first edge 503 is disposed at a radial distance d1 from the axis A along a radius B extending in a radial direction of the fan wheel and intersecting with A and the first edge, and a distance d2 between the first edge and the fan housing along the radius B is at least 0.65 d1 and preferably at least 0.7 d1. It should be noted that FIG. 6 shows an example according to FIG. 4, where d2 has a somewhat lower relation to d1 than this. However by rotating the front part of the combustion air duct 406 with the combustion air intake opening 408 around axis A in an anti clockwise direction the distance d2 will quickly increase, so above and even higher ratios like at least 0.75, 0.80, 0.85, 0.90 and 0.95 can be reached. The advantage with locating the front part of the air duct, so that a higher ratio is attained, is that the braking effect of the cooling air for the engine will decrease. This is because the front part of the combustion air duct forms an obstacle for the air blow in the annular channel between the fan wheel 302 and the fan housing 404. When this annular channel is wider, i.e. a bigger d2, the reduction in cooling air flow is smaller. This means a higher flow and improved cooling. As you can see in FIG. 4 there is an anti clockwise extension of the fan housing 404 that leads all the way to the engine cylinder. This extension is used when measuring very big d2 measurements.

If you rotate the front part of the air duct 406 obviously you will have to curve the air duct 406 with one or two gentle bends to reach to a suitable inlet to the swirling chamber 240. It should be observed that these features also described in claims 16-18 can be used also with other types of precleaning of the combustion air, e.g. the type shown in FIG. 3 or similar types not described in claims 1-15.

Figure 7:
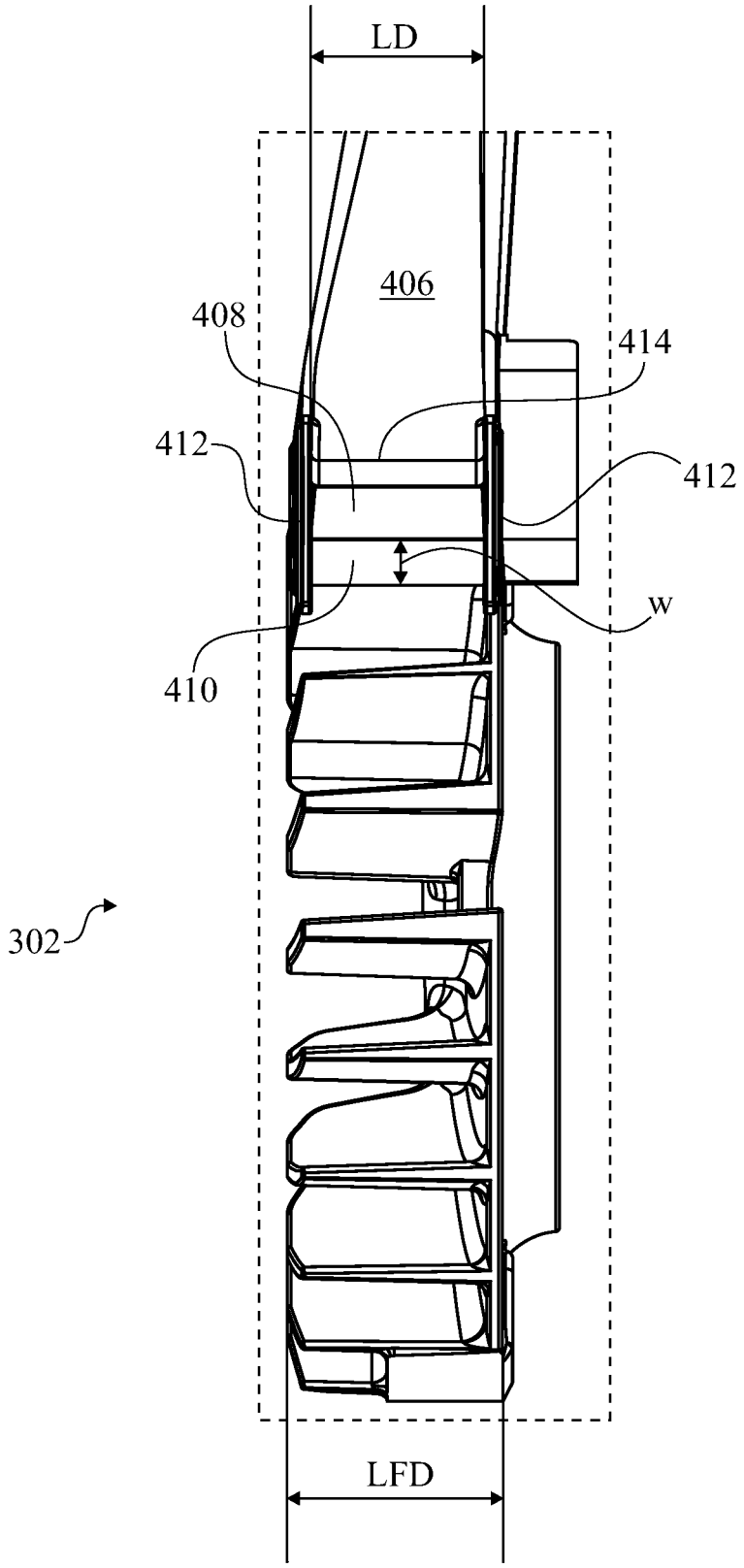
FIG. 7 shows a detailed front view of a combustion air intake opening, according to an embodiment of the present invention.

FIG. 7 shows a detailed front view of the combustion air intake opening 408. As shown in the example embodiment of FIG. 7, two second shielding elements 412 may be attached to each of the lateral sides of the combustion air intake opening 408. A longitudinal distance LD may be provided between two mutually facing surfaces of the two second shielding elements 412 such that the longitudinal distance LD may be smaller than a longitudinal fan distance LFD (LD<LFD). Typically, LFD may be measured as a maximum fan wing longitudinal width. Further, the longitudinal distance LD may be within the longitudinal fan distance LFD such that LFD may overlap LD which may ensure that only fast moving air from the wings of the fan wheel 302 may reach the deflector 410 and the combustion air intake opening 408. Additionally, the second shielding elements 412 may substantially prevent slower speed air from sides to reach the combustion air intake opening 408.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A portable, hand-held, combustion engine powered working machine, comprising:

a tool unit including a working tool;

a machine unit including an internal combustion engine with a crankshaft;

an assembly for supplying cleaned air and fuel to the engine, having an upstream air inlet;

a fan housing located in an outer end of the machine unit and having an air inlet for ambient air;

a fan wheel arranged in the fan housing;

the fan wheel driven directly or indirectly by the crankshaft to supply cooling air, sucked in through the air inlet to cool the engine;

a combustion air duct having a combustion air intake opening located radially outside of the fan wheel leads the combustion air to the assembly for supplying cleaned air and fuel to the engine, wherein the fan wheel has a fan wing width measured in a direction is perpendicular to the fan wheel; and at least one shielding element is used to steer away air and especially particles in the air from said combustion air intake opening to provide a strong cleaning effect of the combustion air in said combustion air duct, and a first shielding element is arranged in the form of a deflector attached to said combustion air intake opening and running in an essentially longitudinal direction, wherein the deflector has a flat or concave shaped outer side, wherein a tangential line oriented along the outer side of the deflector does not intersect with the leading edge of the outer side of said combustion air intake opening.

2. The machine according to claim 1, wherein the combustion air duct is arranged in a generally tangential direction in relation to the fan wheel, and thereby leading the combustion air in a generally tangential direction away from the fan wheel towards the assembly for supplying cleaned air and fuel to the engine.

3. The machine according to claim 2, wherein said deflector is attached at an inner side of said combustion air intake opening.

4. The machine according to claim 2, wherein said deflector has a width in a direction perpendicular to its longitudinal direction that is greater than 3 mm.

5. The machine according to claim 4, wherein the width in the direction perpendicular to its longitudinal direction is greater than 5 mm.

6. The machine according to claim 2, wherein said deflector has an essentially flat or concave outer side, and a deflector line along the deflector outer side extending outwards clears the leading edge of the outer side of said combustion air intake opening.

7. A machine according to claim 2, wherein the combustion air intake opening located radially outside of the fan wheel is providing an entry into the combustion air duct pointing in a similar direction as the combustion air duct itself.

8. The machine according to claim 1, wherein at least one second shielding element is attached on one lateral side of said combustion air intake opening.

9. The machine according to claim 1, wherein a third shielding element is arranged at a radially outer side of said combustion air intake opening, in that a leading edge of the outer side is bent radially inwards.

10. The machine according to claim 1, wherein the machine is a power cutter and the combustion air duct leads the combustion air to the air inlet of the assembly via only a single air filter.

11. The machine according to claim 10, wherein the main filter is a fan-folded paper filter and is maintained by a gasket ring of a soft material encircling the lower circumferential edge of the fan-folded filter, said gasket ring being accommodated in a gasket groove encircling the upper part of an air filter supporting bracket.

12. The machine according to claim 1, wherein the shielding elements steer away air and particles in the air from said combustion air intake opening, so that an air pressure below ambient air pressure is created in said combustion air duct over the complete speed range of the engine.

13. The machine according to claim 12, wherein an air pressure below ambient air pressure is created in said combustion air duct over the working speed range of the engine.

14. The machine according to claim 12, wherein an air pressure below ambient air pressure is created in said combustion air duct and said speed range of the engine in combination with full throttle.

15. The machine according to claim 1, in which the fan wheel rotates about an axis (A) and the combustion air intake opening is provided with a first edge radially adjacent to the periphery of the fan wheel and the first edge is disposed at a radial distance (d1) from the axis (A) along a radius (B) extending in a radial direction of the fan wheel and intersecting with A and the first edge, wherein a distance d2 between the first edge and the fan housing along the radius B is at least 0.65 d1 and preferably at least 0.7 d1.

16. The machine according to claim 15, wherein d2 is at least 0.75 d1.

17. The machine according to claim 16, wherein d2 is at least 0.9 d1.

18. The machine according to claim 1, wherein the tangential line is further tangential to the fan wheel.

19. A portable, hand-held, combustion engine powered working machine, comprising:

a tool unit including a working tool;

a machine unit including an internal combustion engine with a crankshaft;

an assembly for supplying cleaned air and fuel to the engine, having an upstream air inlet;

a fan housing located in an outer end of the machine unit and having an air inlet for ambient air;

a fan wheel arranged in the fan housing, the fan wheel driven directly or indirectly by the crankshaft to supply cooling air, sucked in through the air inlet to cool the engine;

a combustion air duct having a combustion air intake opening located radially outside of the fan wheel, wherein at least one shielding element is used to steer away air and especially particles in the air from said combustion air intake opening to provide a strong cleaning effect of the combustion air in said combustion air duct, and a first shielding element is arranged in the form of a deflector attached to said combustion air intake opening and running in a longitudinal direction in the direction of the crankshaft, wherein said deflector has a substantially flat or concave outer side, the deflector is attached to an inner side of the combustion air intake opening which is the side which is closest to the fan wheel, and wherein a deflector line along the deflector outer side extending outwards does not intersect with the leading edge of the outer side of said combustion air intake opening.

20. A portable working machine comprising:

a machine unit including an internal combustion engine with a crankshaft;

an assembly configured to supply cleaned air and fuel to the engine and having an upstream air inlet;

a fan housing coupled to the machine unit and having an air inlet;

a fan wheel arranged in the fan housing and being directly or indirectly connected to the crankshaft, wherein the fan wheel includes a plurality of wings;

a combustion air duct having a combustion air intake opening located radially outside of the fan wheel, the combustion air duct comprising:

a first shielding element that is arranged in the form of a deflector and is substantially tangential to the fan wheel and having an end portion;

a second shielding element spaced radially away from the deflector, a pair of sidewalls coupling the first shielding element to the second shielding element, wherein the distance between the pair of sidewalls is less than a height of the plurality of wings, wherein a tangential line oriented along an outer surface at the combustion air intake opening extends so that the line does not intersect with the second shielding element.

21. The portable working machine of claim 20, further comprising at least one third shielding element attached to one of the pair of sidewalls.

22. The portable working machine of claim 20, wherein the second shielding element comprises a leading edge that is bent radially toward the first shielding element.

* * * * *